US009283803B2

(12) United States Patent
Nozawa et al.

(10) Patent No.: US 9,283,803 B2
(45) Date of Patent: Mar. 15, 2016

(54) SEALED LETTER FORMING APPARATUS

(75) Inventors: Akiko Nozawa, Tokyo (JP); Tadayuki Wakatabi, Tokyo (JP); Yoshihiro Noguchi, Tokyo (JP)

(73) Assignee: RISO KAGAKU CORPORATION, Tokyo (JP)

( * ) Notice: Subject to any disclaimer, the term of this patent is extended or adjusted under 35 U.S.C. 154(b) by 946 days.

(21) Appl. No.: 13/447,559

(22) Filed: Apr. 16, 2012

(65) Prior Publication Data

US 2012/0260605 A1 Oct. 18, 2012

(30) Foreign Application Priority Data

Apr. 15, 2011 (JP) ..... 2011-091269

(51) Int. Cl.
*B43M 3/04* (2006.01)
*B43M 5/04* (2006.01)
*G03G 15/00* (2006.01)

(52) U.S. Cl.
CPC . *B43M 3/04* (2013.01); *B43M 5/04* (2013.01); *B43M 5/047* (2013.01); *G03G 15/55* (2013.01); *G03G 15/6538* (2013.01); *G03G 15/6594* (2013.01); *G03G 2215/00514* (2013.01); *G03G 2215/00877* (2013.01)

(58) Field of Classification Search
CPC ..... B43M 3/00; B43M 3/02; B43M 3/04; B43M 3/045; B43M 5/042; B65B 57/02; B65B 11/06; B65H 9/002
USPC ..... 53/52, 53, 54, 55, 58, 505, 77, 507, 53/116, 117, 569, 75, 65, 284.3; 270/52.04, 52.05, 52.19, 58.06
See application file for complete search history.

(56) References Cited

U.S. PATENT DOCUMENTS 3,606,728 A * 9/1971 Sather et al. ..... 53/54
5,127,640 A * 7/1992 Orsinger et al. ..... 270/52.04
5,211,384 A * 5/1993 Orsinger et al. ..... B43M 3/045 198/438
5,495,421 A * 2/1996 Hidding ..... 700/213
5,507,129 A * 4/1996 Joson et al. ..... 53/55
5,511,357 A * 4/1996 Ricketts et al. ..... 53/55
5,702,098 A * 12/1997 Gottlieb et al. ..... 270/58.06
5,819,666 A * 10/1998 Ishikawa et al. ..... 101/483
6,418,357 B1 * 7/2002 Chodack et al. ..... 700/220
6,725,126 B1 * 4/2004 Doery ..... 700/221
6,732,011 B1 * 5/2004 Hart et al. ..... 700/223

(Continued)

FOREIGN PATENT DOCUMENTS

JP 06334881 A * 12/1994 ..... B65H 37/04
JP H07-025198 1/1995

(Continued)

*Primary Examiner* — Stephen F Gerrity
(74) *Attorney, Agent, or Firm* — Manabu Kanesaka

(57) ABSTRACT

A sealed letter forming apparatus has a sheet feed unit containing an envelope sheet to be an envelope and a content sheet to be a content; a printer for printing on the respective sheets supplied from the paper feed unit; an enclosing and sealing unit for folding the respective sheets printed by the printer, and enclosing and sealing the respective sheets; and a controller to control the enclosing and sealing unit to stop the sealed letter forming processing when an error related to the envelope sheet or the content sheet in an n-th article occurs, and to perform the sealed letter forming processing without sealing a sealed letter of the n-th article as a sealed letter to be checked by a user when the error is canceled. A sealed letter forming processing is performed on each article which is a combination of the envelope sheet and the content sheet.

8 Claims, 14 Drawing Sheets

(56) References Cited

U.S. PATENT DOCUMENTS

| | | | | |
|---|---|---|---|---|
| 6,741,971 | B1 * | 5/2004 | Duval et al. | 705/401 |
| 7,357,080 | B2 * | 4/2008 | Stemmle et al. | 101/483 |
| 2006/0284360 | A1 * | 12/2006 | Hume et al. | 270/1.02 |
| 2008/0133048 | A1 * | 6/2008 | Wiegmann et al. | B43M 3/04 700/222 |

FOREIGN PATENT DOCUMENTS

| | | | | |
|---|---|---|---|---|
| JP | 11059078 | A * | 3/1999 | B43M 3/04 |
| JP | 2001-096987 | | 4/2001 | |
| JP | 2001096988 | A * | 4/2001 | B43M 3/04 |
| JP | 2002293303 | A * | 10/2002 | B65B 35/50 |

* cited by examiner

Fig.1A ENVELOP SHEET : FRONT SURFACE
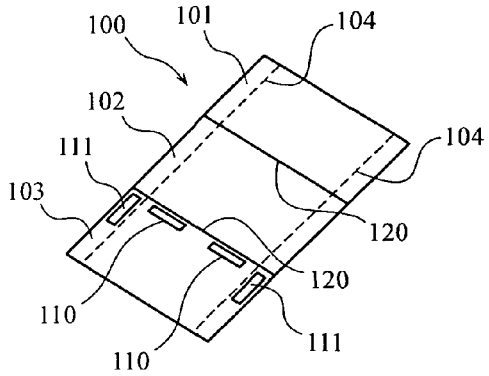
Fig.1B ENVELOP SHEET : REAR SURFACE
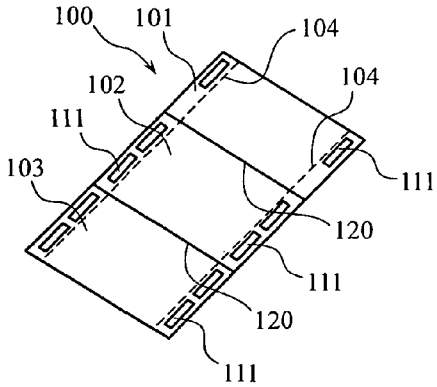
Fig.2A
FOLD
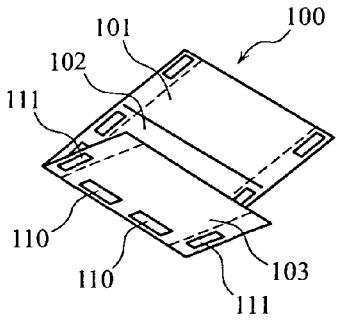
Fig.2B
ENCLOSE
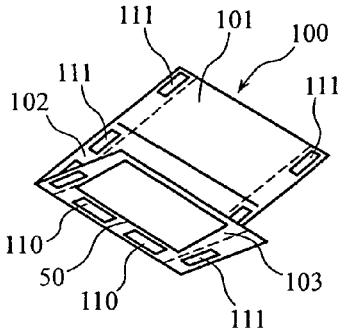
Fig.2C
FOLD AND SEAL
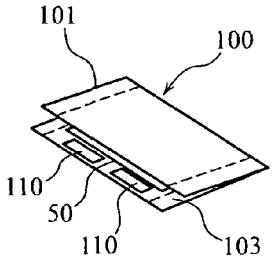

SEALED LETTER FORMING APPARATUS

RELATED APPLICATIONS

The present application is based on, and claims priority from, Japanese Application No. 2011-091269 filed Apr. 15, 2011.

TECHNICAL FIELD

The present invention relates to a sealed letter forming apparatus capable of automatically performing printing on an envelope sheet to be an envelope and a content sheet to be a content, folding the envelope sheet to form an envelope, and performing enclosing and sealing operation on the content sheet, folded in accordance with necessity, as a content, in the envelope, and more particularly, to a sealed letter forming apparatus capable of, in formation of a sealed letter, with a combination of an envelope sheet and a content sheet as an article (of mail), processing the envelope sheet and the content sheet in the same order by article and continuously processing a predetermined number of articles.

BACKGROUND ART

Conventionally, as disclosed in the Patent Literature 1, an enclosing and sealing machine to take in a printed document from a tray type supply unit, fold the document, and perform enclosing and sealing is known. Since this enclosing and sealing machine directly encloses a document from a printer into an envelope and seals the envelope, it is appropriate to formation of a sealed letter requiring confidentiality of content such as contents-certified mail.

However, since the above-described enclosing and sealing machine lacks a mechanism used in combination with a printer, the confidentiality of an enclosed document is not complete. Then, an enclosing and sealing machine available in combination with a printer or a multi-function peripheral to attain high confidentiality is proposed as disclosed in the following Patent Literature 2. This enclosing and sealing machine has taking-in means for taking in a printed sheet discharged from print means, folding means for folding the sheet taken in by the taking-in means, enclosing means for enclosing the sheet folded by the folding means, by one to plural sheets as a unit, into an envelope, sealing means for sealing the paper-enclosed envelope, and conveying means for conveying the sheet among the respective means. Further, the taking-in means is attachable/removable to/from a paper discharge opening of the print means. Since this enclosing and sealing apparatus is used in combination with a printer or a multi-function peripheral, the process from printing on a sheet to enclosing and sealing can be performed at once.

SUMMARY OF INVENTION

Technical Problem

In sealed letter formation, when printing to enclosing and sealing are automatically performed, with the combination of an envelope sheet and single or plural sheet-type content sheets as a content as an "article (of mail)", the envelope sheet and the content sheet are processed in the same order by article, and a predetermined number of articles are continuously processed (this will be referred to as a "Job"). That is, the "article" is a combination of envelope and content sheet, and the "Job" is a set of articles as a unit at execution of continuous sealed letter forming processing.

In the enclosing and sealing machine connected to a printer as disclosed in the above-described Patent Literature 2, the printer sends an envelope sheet and a content sheet into the enclosing and sealing machine in the order of articles. For example, when one article has an envelope and two content sheets, as the order of sheets sent from the printer, the first content sheet of the first article, then the second content sheet of the first article, then the envelope of the first article, the first content sheet of the second article, then the second content sheet of the second article, and the envelope of the second article (by the predetermined number set as a Job) are sent. In this order, there is no shift in the combinations between the envelopes and the content sheets.

However, upon occurrence of error such as paper jam, it is necessary to again perform printing on the article including the error-occurred sheet (envelope sheet or content sheet). This increases the possibility of shift in the combinations of envelope sheets and content sheets. Particularly, in an envelope without a window, it is difficult to check whether or not the combination is correct without opening the envelope to see the content. For example, in a sealed letter of an article, when there is a shift in the combination between an addressee and the content printed on the content sheet, shifts occur in the subsequent combinations between the envelope sheets and the content sheets. Accordingly, to prevent erroneous dispatch of erroneously-combined sealed letters, it is important to check the content of a sealed letter in an error-occurred article.

Note that when a print sheet sequentially supplied from the printer has not been detected with a sensor within a predetermined period calculated from the length of conveyance passage and conveyance speed, it is determined that a paper-jam error has occurred. The sheet detection sensor is provided in plural positions on the conveyance passage. Further, since the conveyance passage is sufficiently longer than the sheet length (the length in the conveyance direction), during printing, plural sheets exist in the machine. Accordingly, all the sheets upstream of a paper-jam error detection position are disposed, while at least one article having a correct set of sheets downstream of the paper-jam error detection position is subjected to normal printing, enclosing and sealing, and discharged as a sealed letter. An article in which sheets are not correctly set is disposed.

Further, the enclosing and sealing machine as disclosed in the above-described Patent Literature 2 lacks means for checking the combination of envelope sheet and content sheet(s) in an article following the error. It is troublesome to open an envelope to check the content upon each occurrence of error, accordingly, printing is often restarted, not from the error-occurred article, but from the beginning of the Job. However, this print restart increases the costs of the sheets. Especially the envelope sheet is expensive. It is desirable to avoid such wasteful disposal.

The present invention has been made in view of the above situation, and has an object to provide a sealed letter forming apparatus in which, when an error occurs in an article and the error is canceled, the sealed letter of the error-occurred article is made easily recognizable as a "sealed letter to be checked", and the content of the sealed letter to be checked is made easily checkable, so as to prevent erroneous dispatch and reduce the costs of the sheets.

Solution to Problem

Next, means to solve the above-described problem will be described with reference to the drawings.

A sealed letter forming apparatus in a first aspect of the present invention is a sealed letter forming apparatus 1 comprising:

a sheet feed unit P (P1 to P4) that contains an envelope sheet 100 to be an envelope and a content sheet 50 to be a content;

a printer 2 that performs printing on the respective sheets 100 and 50 supplied from the paper feed unit P1 to P4; and an enclosing and sealing unit 3 that folds the respective sheets 100 and 50 printed by the printer 2 and performs enclosing and sealing on the respective sheets, wherein, with a combination of the envelope sheet 100 and the content sheet 50 as an article, sealed letter forming processing is performed by article, the apparatus further comprising a controller that, when an error related to the envelope sheet or the content sheet in an n-th article (n is a positive integer) occurs, controls the enclosing and sealing unit 3 to stop the sealed letter forming processing, and thereafter, when the error is canceled, to perform the sealed letter forming processing without sealing a sealed letter of the n-th article as a sealed letter to be checked by a user.

The sealed letter forming apparatus in a second aspect of the present invention is the sealed letter forming apparatus according to the first aspect of the present invention, wherein the controller 90 controls the enclosing and sealing unit 3 to perform sealing with a part of the content sheet 50 sticking out of the envelope sheet 100.

The sealed letter forming apparatus in a third aspect of the present invention is the sealed letter forming apparatus according to the first or second aspect of the present invention, wherein the controller 90 has checking mode selection means for selecting a checking method after cancel of the error, and wherein in the checking mode selection means, when a first disposal mode is selected by the user, the controller 90 controls the enclosing and sealing unit 3 to perform the sealed letter forming processing without sealing the sealed letter in the n-th article, and restart the sealed letter forming processing from the n-th article after checking the sealed letter in the n-th article by the user.

The sealed letter forming apparatus in a fourth aspect of the present invention is the sealed letter forming apparatus according to the first or second aspect of the present invention, wherein the controller 90 has checking mode selection means for selecting a checking method after the cancel of an error, and wherein in the checking mode selection means, when the user selects a reuse mode, the controller 90 controls the enclosing and sealing unit 3 to perform the sealed letter forming processing without sealing a sealed letter of the n-th article as a sealed letter to be checked, and restart the sealed letter forming processing from an n+1-th article.

The sealed letter forming apparatus in a fifth aspect of the present invention is the sealed letter forming apparatus according to the third aspect of the present invention, wherein, at execution of the sealed letter forming processing without sealing a sealed letter of the n-th article, the controller 90 controls the printer 2 to print disposal information on the envelope sheet 100 for the user to recognize that it is a sealed letter to be disposed.

The sealed letter forming apparatus in a sixth aspect of the present invention is the sealed letter forming apparatus according to the first or second aspect of the present invention, wherein the paper feed unit P (P1) contains a sheet 100*a* cheaper than the envelope sheet 100, wherein the controller 90 has checking mode selection means for selecting a checking method after cancel of the error, and wherein, in the checking mode selection means, when the user has selected the second disposal mode, the controller 90 controls the paper feed unit P1 to use the cheap sheet 100*a* as the envelope sheet of the n-th article at execution of the sealed letter forming processing without sealing a sealed letter of the n-th article, and after the sealed letter forming processing without sealing the sealed letter of the n-th article as a sealed letter to be checked, restart the sealed letter forming processing from the n-th article.

The sealed letter forming apparatus in a seventh aspect of the present invention is the sealed letter forming apparatus 1 according to the sixth aspect of the present invention, wherein the controller 90 controls the printer 2 to print a fold register line 120 on the cheap sheet 100*a*.

Advantageous Effects of Invention

According to the sealed letter forming apparatus according to the first aspect of the present invention, upon occurrence of a predetermined error such as paper jam in sealed letter formation, the sealed letter forming processing is performed without sealing the sealed letter of the n-th (n is a positive integer) article including the error-occurred sheet (envelope sheet or content sheet) as a sealed letter to be checked. With this arrangement, the sealed letter to be checked can be easily recognized. Next, the content of the sealed letter to be checked can be easily checked. More specifically, it is easily checked whether or not the envelope sheet and the content sheet correspond to each other, or whether or not printing on the content sheet has been correctly performed. Especially, since it is possible to check whether or not the envelope sheet and the content sheet correspond to each other, it is determined that the subsequent articles have no shift. This avoids a mistake of continuing the sealed letter formation without noticing a shift to end up in wasting sheets. Further, a user can continue his/her work in good conscience. Further, it is unnecessary to perform the sealed letter formation from the beginning of the Job again.

According to the sealed letter forming apparatus in the second aspect of the present invention, since the content sheet sticks out of the envelope sheet in the sealed letter of the n-th article, this sealed letter to be checked is easily recognizable.

According to the sealed letter forming apparatus in the third aspect of the present invention, a first disposal mode is selected to perform the sealed letter forming processing without processing the sealed letter of the n-th article as a sealed letter to be checked, then restart the sealed letter forming processing from the n-th sealed letter. Thus, even when the sealed letter of the n-th article is disposed, there is no shift in the Job.

According to the sealed letter forming apparatus in the fourth aspect of the present invention, the sealed letter forming processing is performed without sealing the sealed letter of the n-th as a sealed letter to be checked, then a reuse mode is selected to restart the sealed letter forming processing from the n+1-th article. This enables reuse of the sealed letter of the n-th article and reduces a waste of sheets. Thus the costs of the sheet can be reduced.

According to the sealed letter forming apparatus in the fifth aspect of the present invention, in the first disposal mode, disposal information is printed on the envelope sheet. Thus the user can easily recognize that the envelope (sealed letter) is a sealed letter to be checked.

According to the sealed letter forming apparatus in the sixth aspect of the present invention, a second disposal mode is selected to perform the sealed letter forming processing, with the sealed letter of the n-th article as a sealed letter to be checked, then restart the sealed letter forming processing from the sealed letter of the n-th article, using a sheet cheaper than the envelope sheet as an envelope sheet of the sealed letter n-th article. Since the expensive envelope sheet is not used in the sealed letter of the n-th article to be disposed, the envelope sheets can be saved. Thus the costs of the sheets can be reduced.

According to the sealed letter forming apparatus in the seventh aspect of the present invention, in the second disposal mode, a fold register line for envelope formation is printed. With this arrangement, it is possible to check whether or not the envelope has been correctly formed. This avoids a folding error to waste expensive envelope sheets and reduces the costs of the sheets. Note that the folding error is caused by a shift of the folding position due to a change of a sheet conveyance amount by abrasion or swelling because rubber conveyance rollers are often used.

BRIEF DESCRIPTION OF DRAWINGS

FIG. 1A is a diagram showing a front surface of an envelope sheet used in an embodiment of the present invention.

FIG. 1B is a diagram showing a rear surface of the envelope sheet.

FIGS. 2A to 2C are diagrams showing a folding order to enclose a content sheet while folding the envelope sheet used in the embodiment.

DESCRIPTION OF EMBODIMENT

Figure 3:
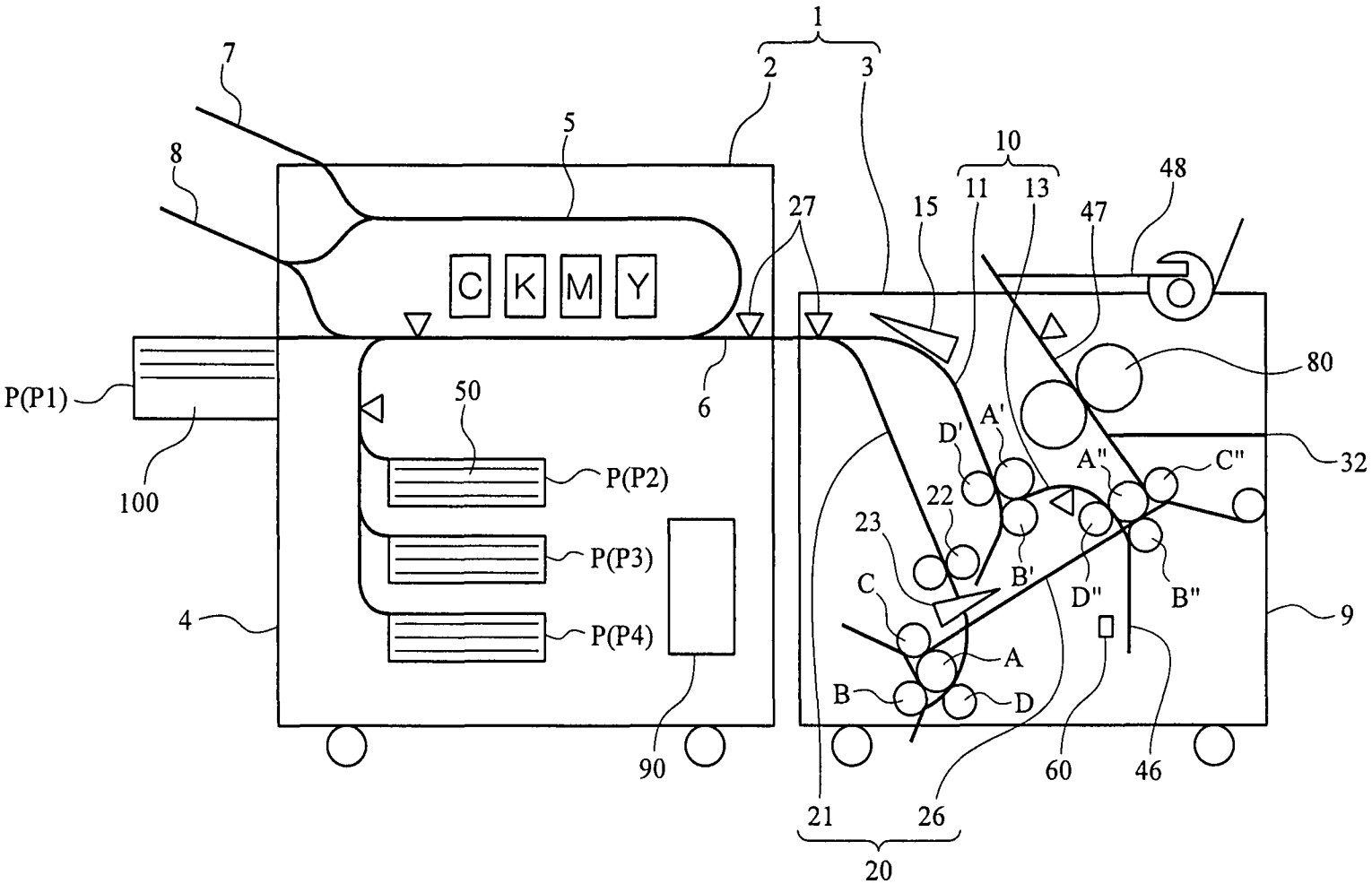
FIG. 3 is a schematic cross-sectional diagram showing the structure of the embodiment.

Hereinbelow, an embodiment of the present invention will be particularly described with reference to the drawings.

The embodiment (sealed letter forming apparatus 1) performs necessary printing on an envelope sheet 100 to be folded into an envelope by sealed letter to be formed and a single or plural sheets of content sheet 50 to be folded in accordance with necessity to be a content, folds them in accordance with necessity while conveying them in respectively different conveyance passages, finally to the same position, encloses the content sheet 50 into the envelope sheet 100, then finally closes the envelope, and discharges it as a sealed letter to an upper part of the apparatus.

First, the shape and structure of the envelope sheet 100 used in the present embodiment, and an operation to fold the envelope sheet 100 into an envelope, enclose the content sheet 50 in the envelope and seals the envelope, thus forms a sealed letter, will be described. Note that the printing on the envelope sheet 100 and the content sheet 50 and the operation to enclose the content sheet 50 with the envelope sheet 100 are actually automatically performed by the sealed letter forming apparatus 1 to be described later.

FIG. 1A shows a front surface (the side where an addressee is printed) of the envelope sheet 100. FIG. 1B shows a rear surface of the envelope sheet 100. The envelope sheet 100 is a rectangular sheet including approximately the same shape of first sheet piece 101, second sheet piece 102 and third sheet piece 103 partitioned with respective fold lines 120.

As shown in FIG. 1, the front surface of the first sheet piece 101 corresponds to the rear side of an envelope on which a sender's name, address and the like are printed. The front surface of the second sheet piece 102 corresponds to the front side of the envelope on which an addressee is printed. Further, on the front surface of the third sheet piece 103, remoistening adhesive 110 such as a gum Arabic adhesive in a band-shape pattern along a widthwise direction is provided in two positions inside the both ends in the widthwise direction and adjacent to the fold line 120 between the third sheet piece 103 and the second sheet piece 102. The remoistening adhesive 110 provides attachment parts for envelope formation.

As shown in FIG. 1, on the respective rear surfaces of the first to third sheet pieces 101 to 103, a pressure-sensitive adhesive 111 as another attachment part for envelope formation is provided in a band shape in a predetermined pattern along both ends in the widthwise direction. The arrangement pattern of the pressure-sensitive adhesive 111 is set such that when the respective sheet pieces are folded to form the shape of an envelope, the heat-sensitive adhesives 111 on corresponding sheet pieces are brought into contact in the same position.

In the envelope sheet 100, i.e., the first sheet piece 101, the second sheet piece 102 and a third sheet piece 103, two perforated lines 104, extending in a direction orthogonal to the fold line 120, are provided at both ends in the widthwise direction, as an unsealing member. The completed envelope can be unsealed along any one of the perforated lines 104. Further, in the envelope sheet 100, in a region surrounded by the pressure-sensitive adhesive 111 and the remoistening adhesive 110, the content sheet 50 is accommodated. The perforated line 104 is provided not to include the pressure-sensitive adhesive 111 and the remoistening adhesive 110 in the accommodation region.

After the printing of the addressee, the content and the like, the envelope sheet 100 is folded so as to enclose the content sheet 50, thus an envelope is formed.

First, as shown in FIG. 2A, the third sheet piece 103 is overlaid on the rear surface side of the second sheet piece 102, and the pressure-sensitive adhesives 111 on both the sheet pieces 102 and 103 are brought into contact.

Next, as shown in FIG. 2B, the content sheet 50 is placed on the front surface of the third sheet piece 103. At this time, the content sheet 50 has a size to be accommodated in the accommodation region of the envelope. That is, the width of the content sheet 50 is smaller than the interval between the pressure-sensitive adhesives 111 printed at the both ends of the respective sheet pieces of the envelope sheet 100. Further, the length in the longitudinal direction of the content sheet 50 may be any length as long as it is, as a maximum length, smaller than a size obtained by subtracting an about half length of the remoistening adhesive 110 in the same direction from the longitudinal length of the respective sheet pieces of the envelope sheet 100.

In this manner, the folding of the content sheet 50 to a size storable in the envelope is attained by performing control by the folding means of the sealed letter forming apparatus 1 to be described later to fold the content sheet 50 in an appropriate position (preferably, a position appropriate to the size of an envelope 150).

In FIG. 2C, water is applied to the remoistening adhesive 110 by water application means to be described later, then the rear surface of the first sheet piece 101 and the front surface of the third sheet piece 103 are brought into contact so as to attach the remoistening adhesive 110 to the rear surface of the first sheet piece 101, and the respective pressure-sensitive adhesives 111 on the sheet pieces 101 and 103 are brought into contact. In this status, the envelope sheet 100 has a form of an envelope folded in three. The remoistening adhesive 110 and the pressure-sensitive adhesive 111 are not attached yet.

Then, through a process to pass the envelope through pressure rollers 80 to be described later so as to hold the pressure-sensitive adhesives 111 at the both ends of the envelope in the widthwise direction, the both ends of the respective sheet pieces are attached with the pressure-sensitive adhesive 111. Further, through the process to hold and convey the envelope, the first sheet piece 101 and the third sheet piece 103 are folded in the longitudinal direction, thus a non-closed end is attached with the remoistening adhesive 110. Thus a sealed letter in which the content is enclosed in the envelope is formed.

Next, the entire configuration and primary functions of the present embodiment (sealed letter forming apparatus 1) will be described with reference to FIG. 3.

In the sealed letter forming apparatus 1 shown in FIG. 3, processing is performed by sealed letter to be formed. That is, necessary printing is performed on the envelope sheet 100 and the content sheet 50 as a paper sheet using a common printer 2 in an appropriate order. Then, after the printing, the envelope sheet 100 and the content sheet 50 are sent to an enclosing and sealing unit 3, then conveyed on respectively different conveyance passages while the envelope sheet 100 is folded to the form of an envelope and the content sheet 50 is folded in accordance with necessity to have a size as a content of the envelope. Then finally, the both sheets are brought to the same position by the enclosing and sealing means, the content sheet 50 is enclosed in the envelope sheet 100 and the envelope is sealed, and the envelope is discharged as a completed sealed letter to the upper part of the apparatus.

Figure 4:
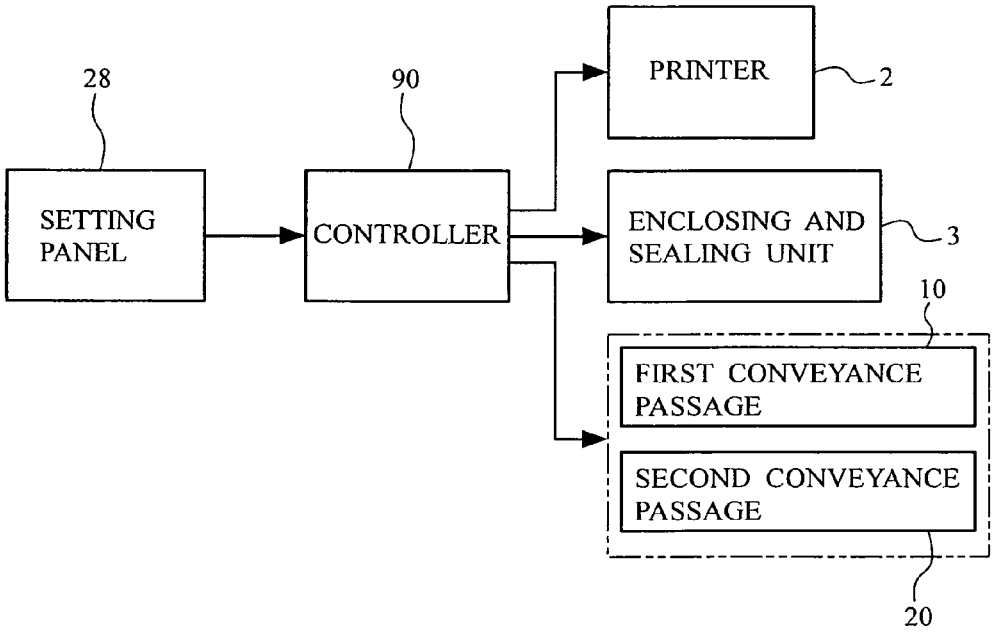
FIG. 4 is a block diagram showing a control function in the embodiment.

As shown in FIG. 4, the sealed letter forming apparatus 1 has the printer 2 to perform printing on the envelope sheet 100 and the content sheet 50 and discharge them. The printer 2 has plural sheet feed trays P (P1 to P4) as sheet feed units which can contain plural types of printing materials (the envelope sheets 100 and the content sheets 50) inside or on the side surface of the case 4 accommodating the respective elements of the apparatus. In this embodiment, the envelope sheets 100 are contained in the sheet feed tray P1 attached to the side surface of the case 4, and the content sheets 50, in respective sizes, are contained in the sheet feed trays P2 to P4 provided inside the case 4.

The sheet supplied from these sheet feed trays P is sent from an introduction passage to a looped conveyance passage 5 and conveyed there, and an image is formed by print means arranged faced down at predetermined intervals along a lower half part of the conveyance passage 5. In the present embodiment, as a print means, four ink-jet heads C, K, M and Y to discharge cyan, black, magenta and yellow color ink are arranged.

The looped conveyance passage 5 is branched to a first discharge passage 6 at a downstream adjacent part of the above-described print means to discharge the sheet to the outside the loop in an approximately horizontal direction. Further, the looped conveyance passage 5 is branched to a second discharge passage 7 at an upper half part to discharge the sheet to the outside the loop, and branched to a switch back passage 8 between the sheet feed tray P and the introduction passage. The switch back passage 8 receives the sheet conveyed on the conveyance passage 5, then returns the sheet to the conveyance passage 5, thus the switch back passage 8 reverses the sheet in the conveyance passage 5. As the sheet surface is reversed and passed through the conveyance passage 5 twice, color image printing is performed to form color images on both surfaces of the sheet with the ink-jet heads C, K, M and Y.

The enclosing and sealing unit 3, to receive and process the envelope sheet 100 and the content sheet 50 sent from the first discharge passage 6 of the printer 2, and enclose the content sheet 50 in the envelope sheet 100 and seal the envelope, is provided at an adjacent position to the printer 2.

The first discharge passage 6 of the printer 2 is projected to a horizontally extended outer part and introduced in a case 9 of the adjacent enclosing and sealing unit 3. In the case 9, a second conveyance passage 20 is branched from the discharge passage 6 diagonally downward, and its further downstream part is a passage 11 extended diagonally downward as one passage of a first conveyance passage 10.

The one passage 11 of the first conveyance passage 10 is provided approximately in parallel to one passage 21 of a second conveyance passage 20. The one passage 11 of the first conveyance passage 10 is a guide passage to convey the envelope sheet 100 to the folding means. The one passage 21 of the second conveyance passage 20 is a guide passage to convey the content sheet 50 to the folding means. The switching between the first conveyance passage 10 and the second conveyance passage 20 is performed with a switching flap 15 provided at a branch point between the first discharge passage 6 and the second conveyance passage 20.

First folding means for folding the envelope sheet 100 and forming an envelope is provided at a terminal end of the one passage 11 of the first conveyance passage 10. The first folding means is provided with a rotatable main folding roller A', a sheet conveyance roller D' and a first folding roller B' to rotate in contact with the main folding roller A'. These rollers are rubber members, and the length in their widthwise direction is greater than the width of the envelope sheet 100.

A conveyance passage 13 as the other passage of the first conveyance passage 10 is extended in an approximately horizontal direction while being curved upwardly, from a position between the main folding roller A' of the first folding means and the first folding roller B' in the first conveyance passage 10. The terminal end of the other passage 13 of the first conveyance passage 10 to convey the envelope sheet 100 is introduced to the enclosing and sealing means to be described later.

The second conveyance passage 20 to convey the content sheet 50 printed with the printer 2 is provided inside the case 9 of the enclosing and sealing unit 3. The second conveyance passage 20 is positioned lower than the first conveyance passage 10, and is provided with one passage 21 to send diagonally downward the sheet sent in the approximately horizontal direction from the first discharge passage 6 of the printer 2.

A sheet conveyance roller 22 and a matching unit 23 as an openable/closable gate are provided in the middle of the passage 21. The conveyed sheet is held with the matching unit 23 closing the passage 21, thus the sheets are stacked in the passage 21. Further, the folding means for folding the sheet is provided at the terminal end of the passage 21. The folding means is provided with a rotatable central main folding roller A, further, a first folding roller B, a second folding roller C and one sheet conveyance roller D are rotatably in contact with the main folding roller A. These rollers are rubber members, and the length in their axial direction is greater than the width of the envelope sheet 100.

In the case 9 of the enclosing and sealing unit 3, the second conveyance passage 20 has another passage 26 to convey the content sheet 50 folded by the folding means. The other passage 26 is merged with the other passage 13 of the first conveyance passage 10 in the enclosing and sealing means.

Further, a sheet passage detection sensor 27 is provided in plural positions of the first discharge passage 6, the branch points of the first and second conveyance passages 10 and 20, and the respective passages 11, 13, 21 and 26.

Next, the enclosing and sealing means at the meeting point of the first conveyance passage 10 and the second conveyance passage 20 will be described.

The enclosing and sealing means has a function as second folding means for further folding the envelope sheet 100 in accordance with necessity. The enclosing and sealing means is enclosing means for enclosing the content sheet 50 in the envelope sheet 100 by matching the content sheet 50 to the folded envelope sheet 100 then further folding, and further has sealing means for sealing the envelope sheet 100.

The enclosing and sealing means is provided with a rotatable main folding roller A" as the second folding means, a sheet conveyance roller D" and first and second folding rollers B" and C" rotated in contact with the main folding roller A". These rollers are rubber members, and the length in their axial direction is greater than the width of the envelope sheet 100. The envelope sheet 100 is folded by the above-described main folding roller A' as the first folding means, the first folding roller B' and the like in accordance with necessity, and further, sent to the main folding roller A" as the second folding means or the like, and further folded before/after enclosing in accordance with necessity.

A passage 46 faced downward is provided between the main folding roller A" and the sheet conveyance roller D" of the enclosing and sealing means. In the vicinity of the passage 46, water application means 60 is provided as attaching means to apply water to the remoistening adhesive 110 of the envelope sheet 100 to cause an adhesive force, and attach the envelope sheet 100 to form it in an envelope.

A passage 47 sloped diagonally front-upward is provided between the main folding roller A" and the second folding roller C" of the enclosing and sealing means. The passage 47 is provided with the conveyance rollers and pressure rollers 80 as the sealing means which is a part of the enclosing and sealing means along the conveyance direction of the envelope sheet 100. The upper and lower pressure rollers 80 are provided as a pair, and hold and apply pressure to the both ends in the width direction of the envelope sheet 100 in which the content sheet 50 is enclosed from the upper and lower directions, to perform sealing with the pressure-sensitive adhesive 111. The sealed letter formed by completion of sealing is discharged through the passage 47 onto a discharge tray 48 provided on an upper surface of the case 9.

Further, as shown in FIG. 4, the sealed letter forming apparatus 1 has a controller 90 to control the entire apparatus including the first and second conveyance passages 10 and 20 in addition to the above-described printer 2 and the enclosing and sealing unit 3. The controller 90 controls the folding positions of the envelope sheet 100 and the content sheet 50, and the position of the content sheet 50 when enclosed in the envelope sheet 100.

Figure 5:
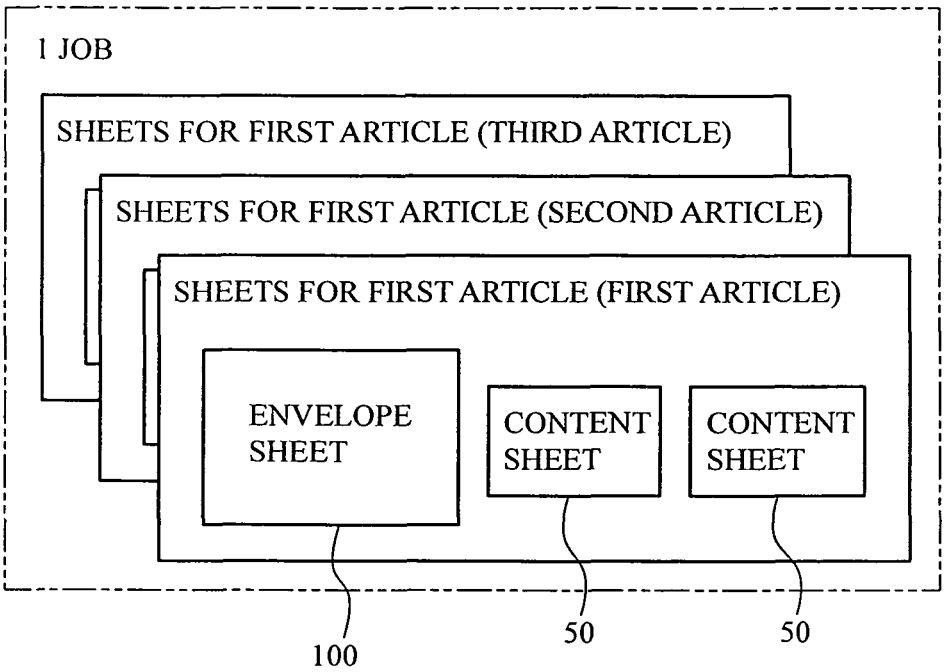
FIG. 5 is a conceptual diagram showing the relation between an article and a Job in sealed letter formation in the embodiment.

Further, as shown in FIG. 5, in the present embodiment, in sealed letter formation, when printing to enclosing and sealing are automatically performed, as described above, with the combination of the envelope sheet 100 and the content sheet 50 as an "article", sealed letter forming processing is performed for each article. In the sealed letter forming processing, the envelope sheet 100 and the content sheet 50 are processed in the same order, and a predetermined number of articles are continuously processed. This is referred to as a "Job". That is, the "article" means the combination of the envelope sheet 100 and the content sheet 50, and the "Job" means a set of articles as a unit when the sealed letter forming processing is continuously performed at once.

Figure 6:
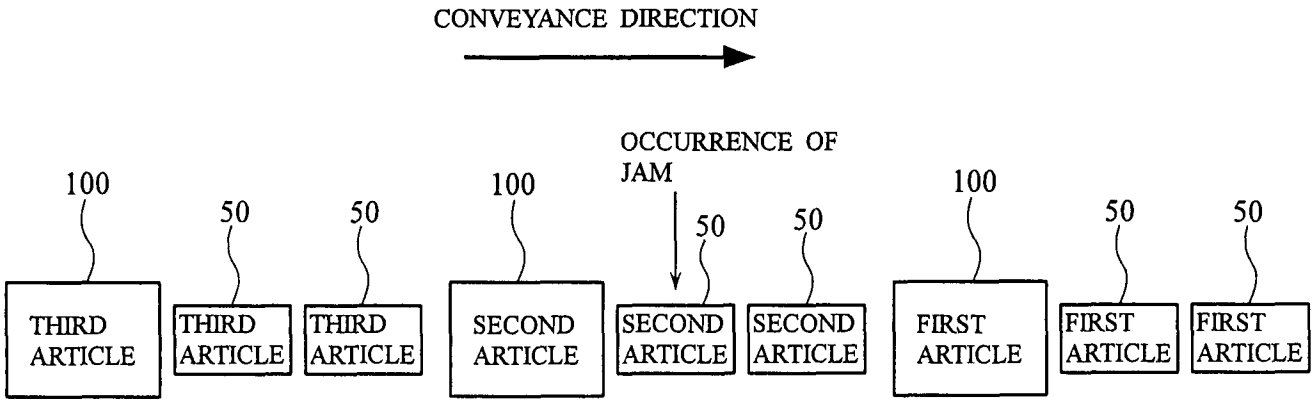
FIG. 6 is a diagram of a restart image in the case of paper jam error upon sealed letter formation.

As shown in FIG. 6, when one article has the envelope sheet 100 and two content sheets 50, the order of the sheets sent from the printer 2 to be described later becomes as follows: the first content sheet 50 of the first article, the second content sheet 50 of the first article, the envelope sheet 100 of the first article, the second content sheet 50 of the second article, the second content sheet 50 of the second article, and the envelope sheet 100 of the second article . . . (hereinbelow, by the predetermined number of articles set as the Job). Generally, the combinations between the envelope sheets 100 and the content sheets 50 are not shifted.

However, as shown in FIG. 6, when an error such as paper jam occurs in the second content sheet 50 of the n-th article (the second article in FIG. 6), it is necessary to temporarily stop the apparatus to stop the sealed letter forming processing, then, when the error has been canceled, it is necessary to perform the sealed letter forming processing from the error-occurred article. Note that the alphabet "n" is a positive integer. In the present embodiment, in sealed letter formation, when a predetermined error such as paper jam occurs, the control means (controller 90) controls the enclosing and sealing unit 3 to perform the sealed letter forming processing without sealing the sealed letter of the n-th article to be checked by the user.

The controller 90 has checking mode selection means for selecting a checking method (checking mode) for the user to check whether the envelope sheet 100 and the content sheet 50 are correctly combined after cancel of the error. Note that the setting of the checking mode and the like are performed from a setting panel 28 as shown in FIG. 4. The setting panel 28 is provided on the printer 2.

When the sheet passage detection sensor 27 has not detected passage of a sheet conveyed on the respective passages in the enclosing and sealing unit 3, the sensor 27 outputs a signal to the controller 90. The controller 90 receives the output signal from the sensor 27, then performs the above-described checking mode. Note that as the paper jam error, it is determined that an error has occurred when the sensor 27 has not detected a sheet sequentially supplied from the printer 2 within a predetermined period calculated from the length of the conveyance passage and the conveyance speed.

Hereinbelow, a processing procedure to the checking mode by the controller 90 and a processing procedure of a checking mode selected by the checking mode selection means will be particularly described with reference to FIGS. 7 and 8.

Figure 7:
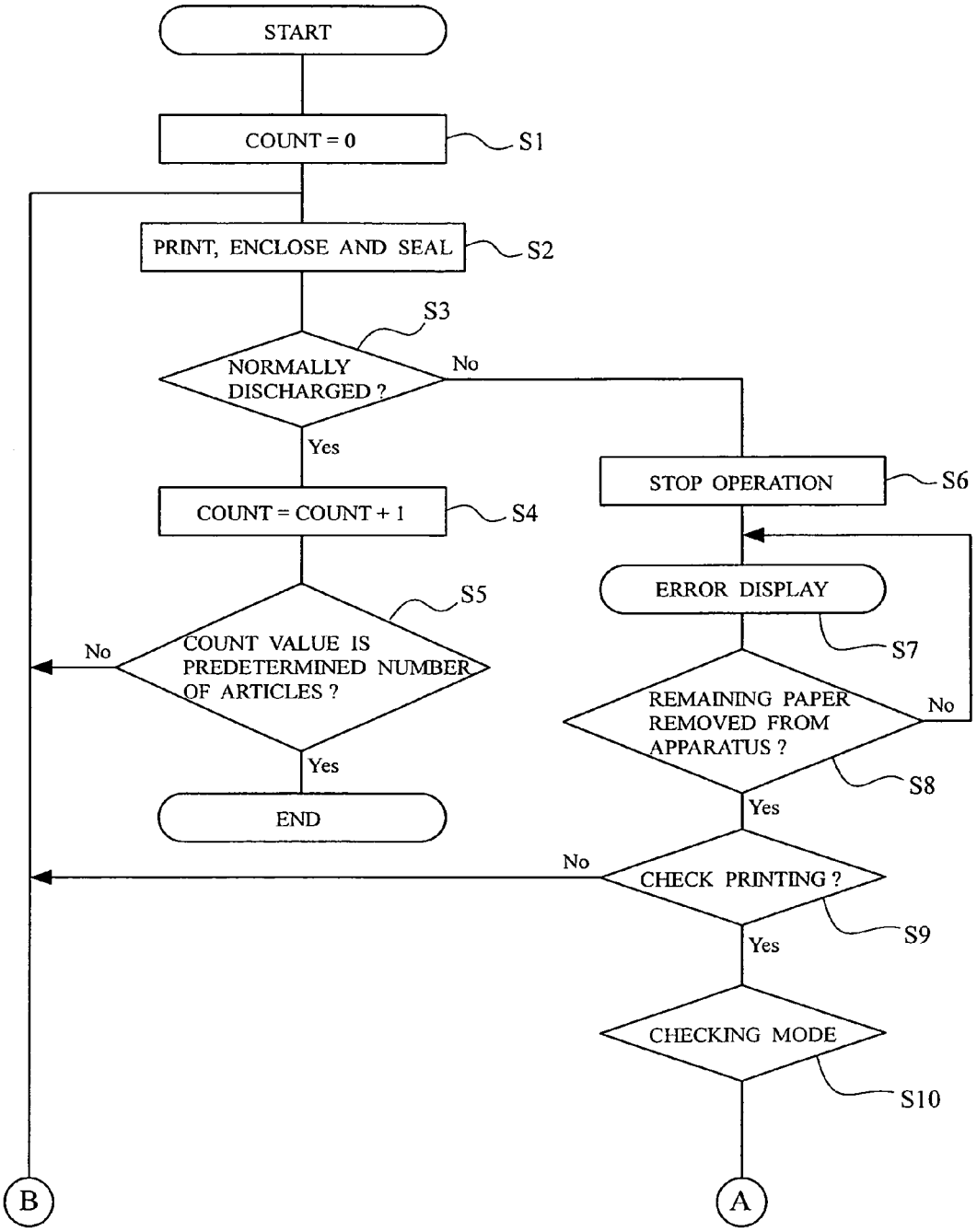
FIG. 7 is a flowchart showing a processing procedure of a checking mode of the embodiment.
Figure 8:
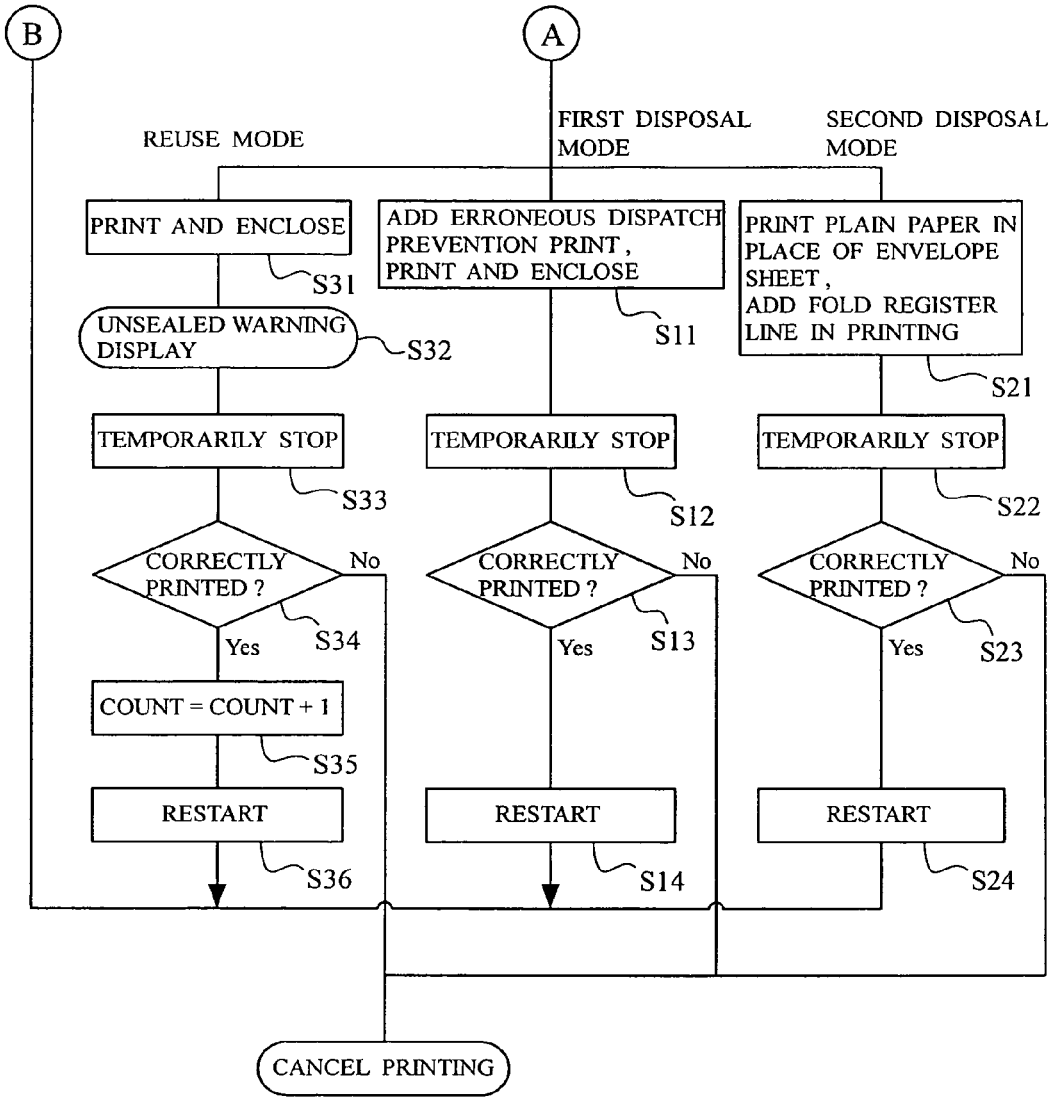
FIG. 8 is a flowchart showing a processing procedure of another checking mode of the embodiment.

As shown in FIG. 7, the controller 90 counts the sealed letter formation, i.e., the print, enclosing and sealing processing until the number of articles becomes a predetermined number set as the Job upon sealed letter formation (S1 and S2). At this time, when a sealed letter is normally discharged (S3), the sealed letter is counted (S4). When the count value corresponds to the predetermined number of articles set as the Job (S5), the process ends. Note that at step S5, when the number of articles is not the predetermined number, the above-described processing is repeated until the count value reaches the predetermined number.

Further, at step S3, when a sealed letter is not normally discharged, the sealed letter forming processing operation including the printing is stopped (S6), and an error display is produced (S7). Thereafter, all the sheets remaining in the printer 2 and the enclosing and sealing unit 3 are discharged. When some sheets remain (S8), the error display is continued. When there is no remaining sheet (S8), whether to perform check printing not is selected (S9). At step S9, when it is determined not to perform the check printing, the processing is performed again from step S2.

At step S9, when the check printing is performed, the checking mode (S10) is performed. As shown in FIG. 8, it is possible to select processing from disposal processing (first disposal mode and second disposal mode) and reuse processing (reuse mode) by use of the checking mode selection means. The first disposal mode is to dispose the sealed letter of the error-occurred article. The second disposal mode is to change the envelope sheet of the error-occurred article to a sheet 100*a* cheaper than the envelope sheet such as a plain sheet and form an envelope. The reuse mode is to reuse the sealed letter of the error-occurred article.

When the checking mode selection means has selected the first disposal mode, the controller 90 controls the enclosing and sealing unit 3 to perform the sealed letter forming processing without sealing the error-occurred sealed letter of the n-th article as a sealed letter to be checked, and to restart the sealed letter forming processing from the n-th article. The controller 90 controls the printer 2 so as to print disposal information, recognizable for the user as a sealed letter to be disposed, on the envelope sheet 100.

Figure 9A:
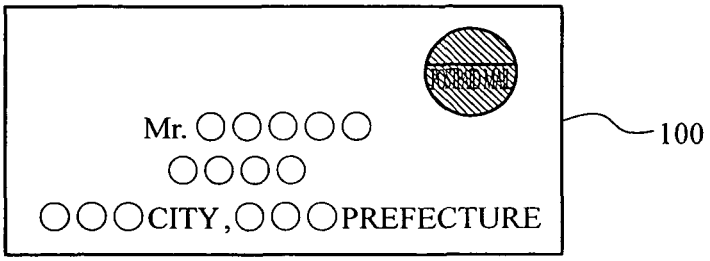
FIG. 9A to 9C are diagrams showing a print example indicating disposal information (print example for erroneous dispatch prevention) in disposal processing.
Figure 9B:
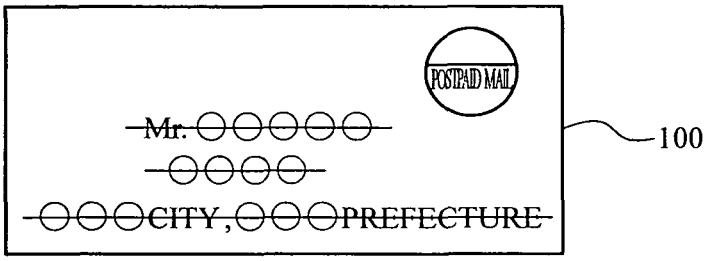
Figure 9C:
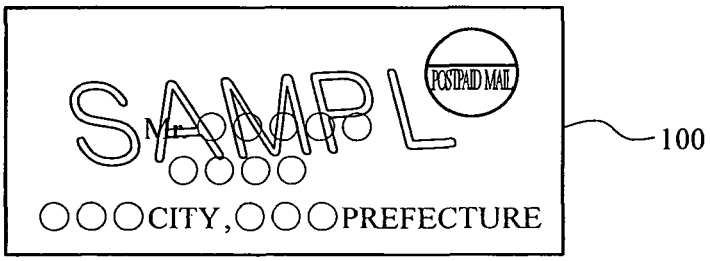

In the first disposal mode, the disposal information, e.g., erroneous dispatch prevention printing is additionally performed, then the enclosing processing is performed (S11). Note that as the erroneous dispatch prevention printing, examples shown in FIGS. 9A to 9C may be used. FIG. 9A shows an example of printing to fill a part to which a postage stamp is attached; FIG. 9B shows an example of printing to add a cross-off line to an address and an addressee; and FIG. 9C shows an example of printing to add a designed letter "SAMPLE". When the above-described processing at step S11 has been completed, the sealed letter forming processing is temporarily stopped (S12). At this time, when printing is correctly performed on the sealed letter to be checked, the sealed letter forming processing is restarted (S14) from the error-occurred sealed letter of the n-th article. Then the processing is performed from the above-described step S2. Further, if the printing has not been correctly performed on the sealed letter to be checked (S12), the printing is cancelled. In this case, there is a possibility of occurrence of a problem in e.g. the printer 2.

In the checking mode selection means, when the second disposal mode has been selected, the controller 90 controls the sheet feed unit P to use the sheet 100*a* such as a plain sheet cheaper than the envelope sheet 100 at execution of the sealed letter forming processing without sealing the sealed letter of the n-th article. Further, the controller 90 controls the enclosing and sealing unit 3 to, after the execution of the sealed letter forming processing without sealing the error-occurred sealed letter of the n-th article as a sealed letter to be checked, restart the sealed letter forming processing from the n-th article. In this case, the above arrangement is realized by previously setting one of the sheet feed trays P2 to P4 as a sheet feed unit to contain the sheets 100*a*. Further, the controller 90 controls the printer 2 to print a fold register line 120 on the plain sheet 100*a* to be used as an envelope sheet.

Figure 10A:
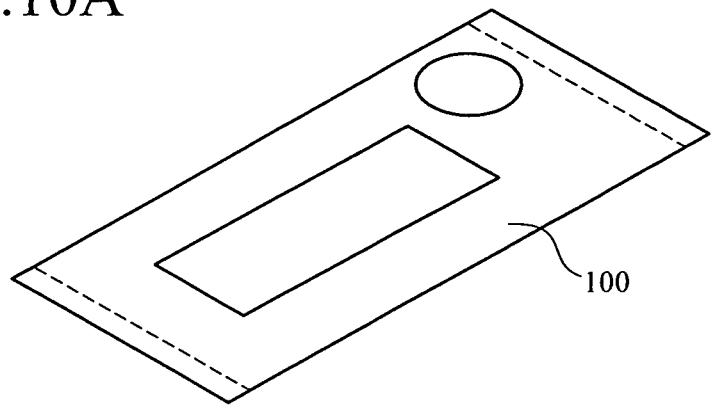
FIG. 10A is a diagram showing a normally formed sealed letter (envelope) as a comparative example in the disposal processing.
Figure 10B:
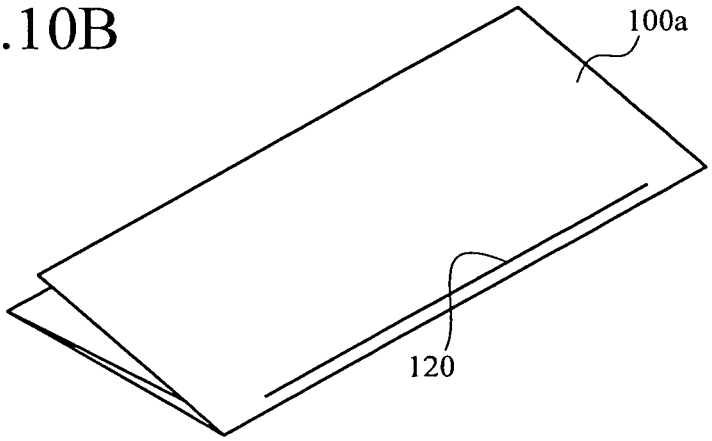
FIG. 10B is a diagram showing an envelope formed using a sheet cheaper than the envelope sheet, in the disposal processing.

In the second disposal mode, printing is performed on the plain sheet 100*a* in place of the envelope sheet 100. At the same time, in printing, as shown in FIG. 10B, the fold register line 120 for formation of an envelope is added to the plain sheet 100*a* used as the envelope sheet 100 (S21). Note that FIG. 10A shows a normally formed sealed letter (envelope 150) as a comparative example. Then, when the processing at step S21 has been completed, the sealed letter forming processing is temporarily stopped (S22). At this time, when the sealed letter to be checked is correctly printed, the sealed letter forming processing is restarted from the error-occurred n-th article (S24), to perform the processing from step S2. If the sealed letter to be checked is not correctly printed (S23), the printing is cancelled. In this case, there is a possibility of occurrence of another problem in the printer 2 or the like.

In the checking mode selection means, when the reuse mode has been selected, the controller 90 controls the enclosing and sealing unit 3 to perform the sealed letter forming processing without sealing the sealed letter of the n-th article as a sealed letter to be checked, and to restart the sealed letter forming processing from the n+1-th article.

In the reuse mode, the printer 2 performs printing, then the enclosing and sealing unit 3 performs enclosing of the content sheet 50 (S31). At this time, since the sealed letter is not sealed, a warning display indicating that the sealed letter is unsealed is produced (S32). This prevents erroneous dispatch of an unsealed letter. Thereafter, the sealed letter forming processing is temporarily stopped (S33). At this time, when the sealed letter to be checked is correctly printed (S34), the sealed letter is counted as a normal sealed letter (S35), then the sealed letter forming processing is restarted from the n+1-th article following the error-occurred n-th article (S36). Further, if the sealed letter to be checked is not correctly printed (S34), the printing is cancelled. In this case, there is a possibility of occurrence of another problem in the printer 2 or the like.

Figure 11A:
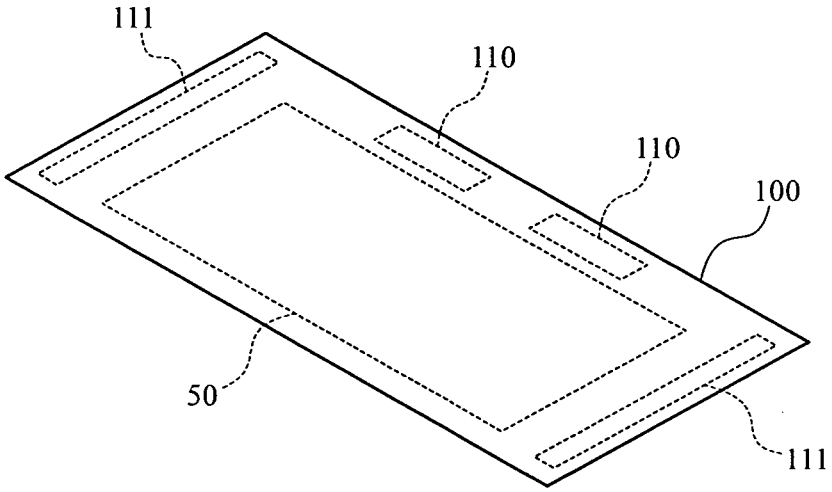
FIG. 11A is a diagram showing a normally formed sealed letter as a comparative example in the disposal processing or reuse processing.
Figure 11B:
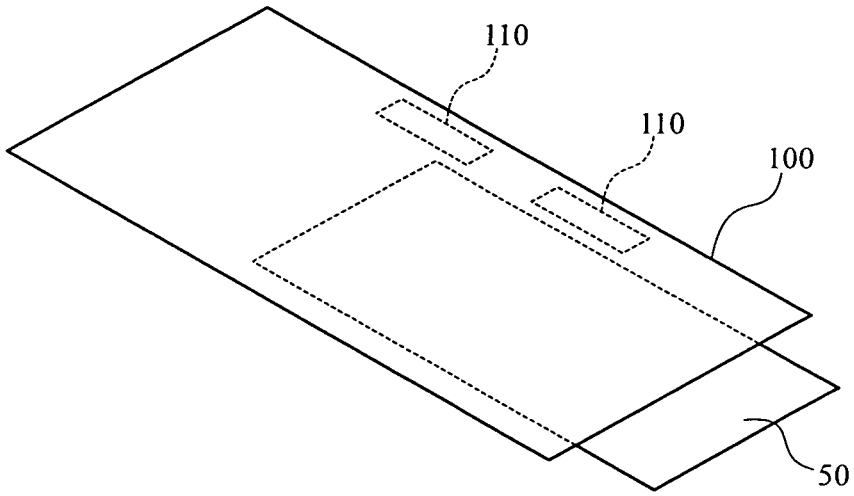
FIG. 11B is a diagram showing a sealed letter with a part of the content sheet sticking out of the envelope sheet, in the disposal processing or the reuse processing.
Figure 12:
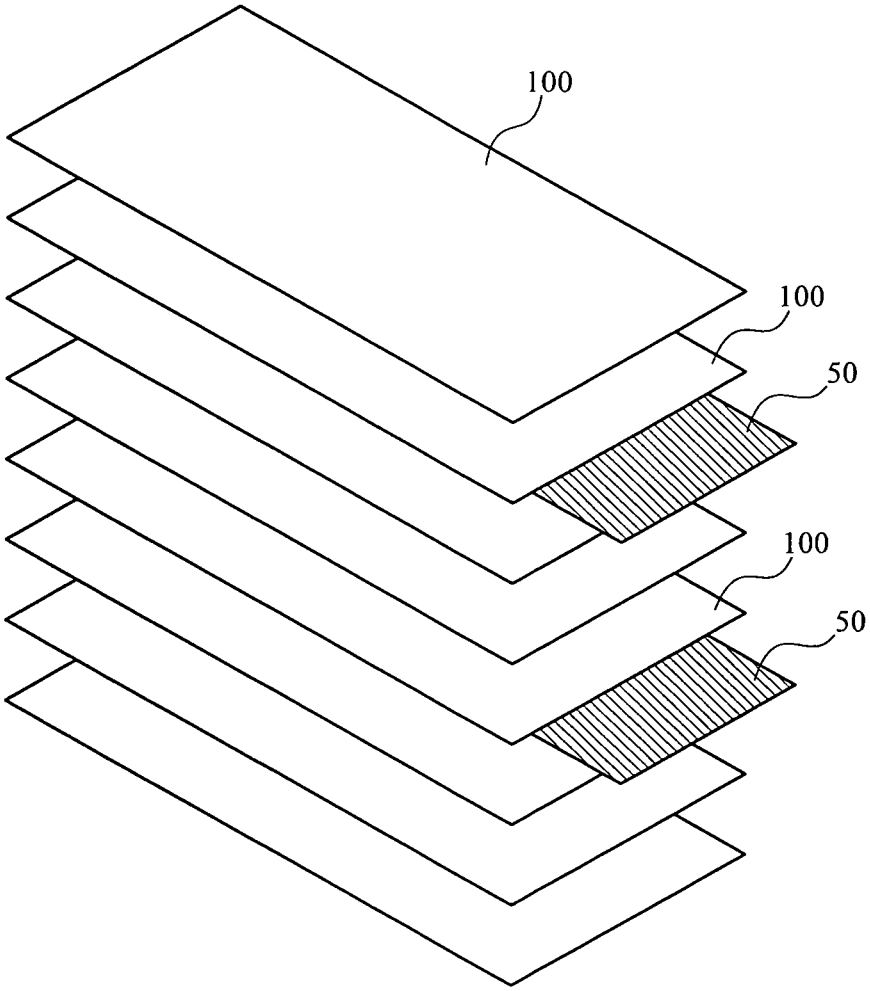
FIG. 12 is a diagram showing a status where the sealed letter shown in FIG. 10B is actually applied.

Further, in the present embodiment, in the respective checking modes, the envelop sheet 100 is ejected with a part of the content sheet 50 sticking out so as to easily recognize a sealed letter to be checked. As shown in FIG. 11B, in the sealed letter with a part of the content sheet 50 sticking out of the envelope sheet 100, the attachment with the pressure-sensitive adhesive 111 applied in the widthwise direction of the envelope is not performed. Note that FIG. 11A shows, as a comparative example, a normally formed sealed letter in which the content sheet 50 is completely enclosed in the envelope sheet 100. As shown in FIG. 12, with the content sheet 50 sticking out of the envelope sheet 100, the sealed letter to be checked can be easily recognized even when it is mixed in normal sealed letters. This further infallibly prevents erroneous dispatch of a sealed letter to be checked (unsealed mater).

Next, a structure and a process for enclosing the content sheet 50 in the envelope sheet 100 with a part of the content sheet 50 sticking out of the envelope sheet 100 in sealed letter formation will be described with reference to FIGS. 13 to 14.

Figure 13:
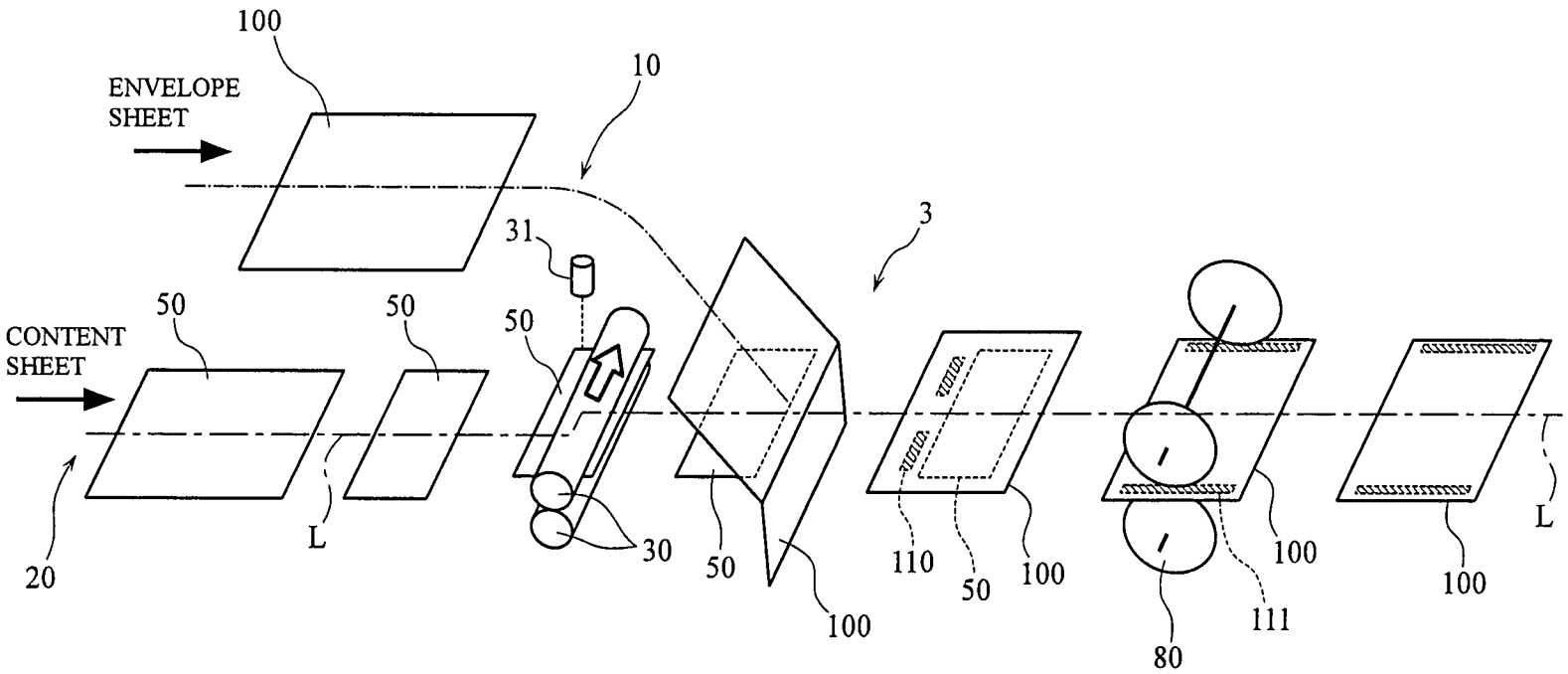
FIG. 13 is a diagram showing an enclosing and sealing process in normal processing.

FIG. 13 shows the enclosing and sealing process of the content sheet 50 in normal sealed letter formation. In normal sealed letter formation, first, the second folding means performs necessary folding on the content sheet 50 conveyed on the second conveyance passage. Note that in this example, the content sheet 50 is folded in three. Next, the content sheet 50 folded in three is held with holding rollers 30, and subjected to positioning by moving the content sheet 50 in the widthwise direction to align a conveyance center line L to a proper position. The positioning is performed by detecting any one end of the content sheet 50 in the widthwise direction with a sensor 31. Next, in the enclosing and sealing unit 3, the positioning-processed content sheet 50 and the envelope sheet 100 conveyed on the first conveyance passage are brought to the same position, in which the envelope sheet 100 is folded so as to enclose the content sheet 50, thus an envelope is formed. Further, at this time, the remoistening adhesive 110 applied with water by the water application means 60 is attached, and the envelope sheet 100, with its both ends in the widthwise direction are opened, encloses the content sheet 50. Finally, the envelope sheet 100 is held and conveyed with the pressure rollers 80, thus the pressure-sensitive adhesives 111 applied at the both ends in the widthwise direction are attached, and an envelope is completed.

Figure 14:
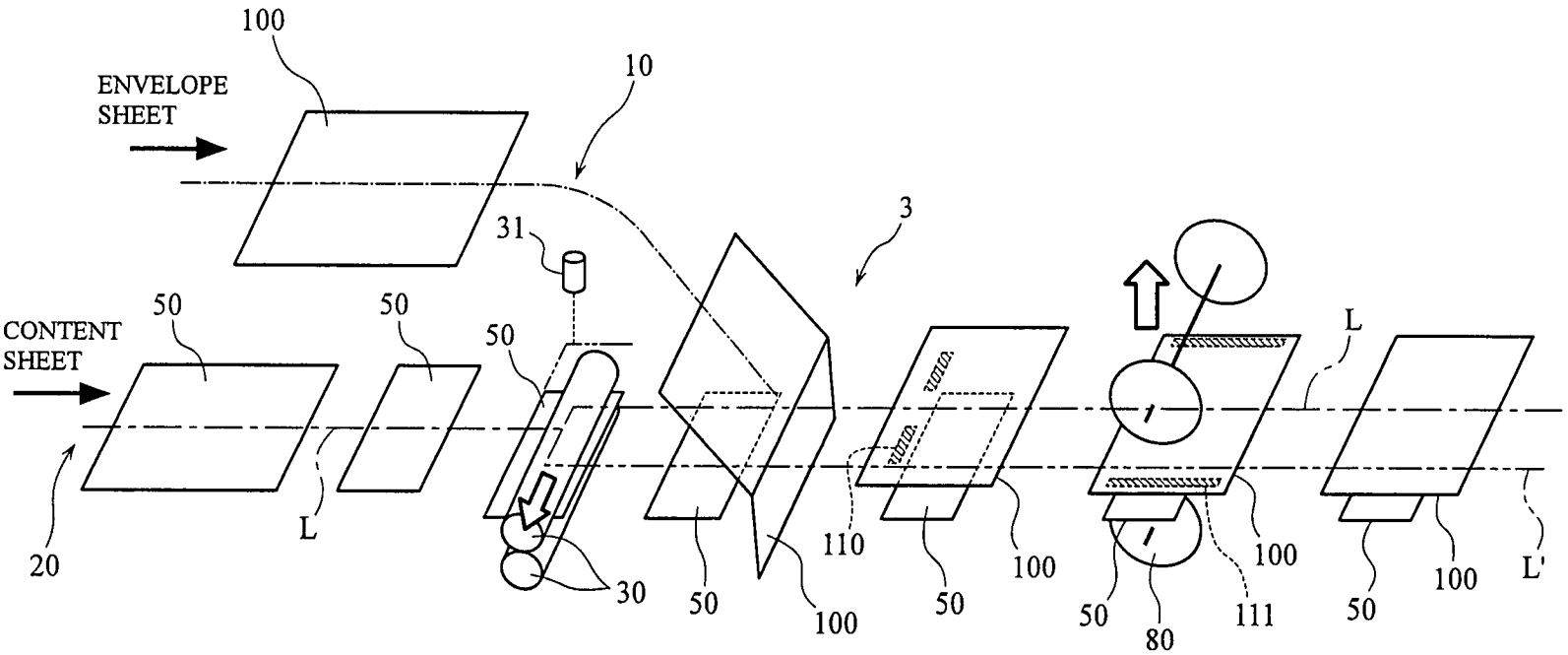
FIG. 14 is a diagram showing the enclosing process in the disposal processing or the reuse processing.

FIG. 14 shows the enclosing process of the content sheet 50 in formation of a sealed letter to be checked in the checking mode (the first and second disposal modes and the reuse mode). In formation of a sealed letter to be checked, first, the second folding means performs necessary folding on the content sheet 50 as a paper sheet conveyed on the second conveyance passage. In this example, the content sheet 50 is folded in three. Next, the content sheet 50 folded in three is held with the holding rollers 30, and the content sheet 50 is moved to shift the conveyance center line L in the widthwise direction by a predetermined amount as a line L'. Note that the movement at this time is not necessarily precisely performed. Next, in the enclosing and sealing unit 3, the position-shifted content sheet 50 and the envelope sheet 100 conveyed on the first conveyance passage are brought to the same position, in which the envelope sheet 100 is folded so as to enclose the content sheet 50, thus an envelope is formed. Further, at this time, the remoistening adhesive 110 applied with water by the water application means 60 is attached, and the envelope sheet 100, with its both ends in the widthwise direction are opened, and with a part of the content sheet 50 sticking out of one end, encloses the content sheet 50. Finally, the envelope sheet 100 is held and conveyed with the pressure rollers 80 moved in the widthwise direction, the pressure-sensitive adhesive 111 applied to both ends in the widthwise direction is not attached, thus a sealed letter to be checked with a part of the content sheet 50 sticking out is completed.

Figure 15:
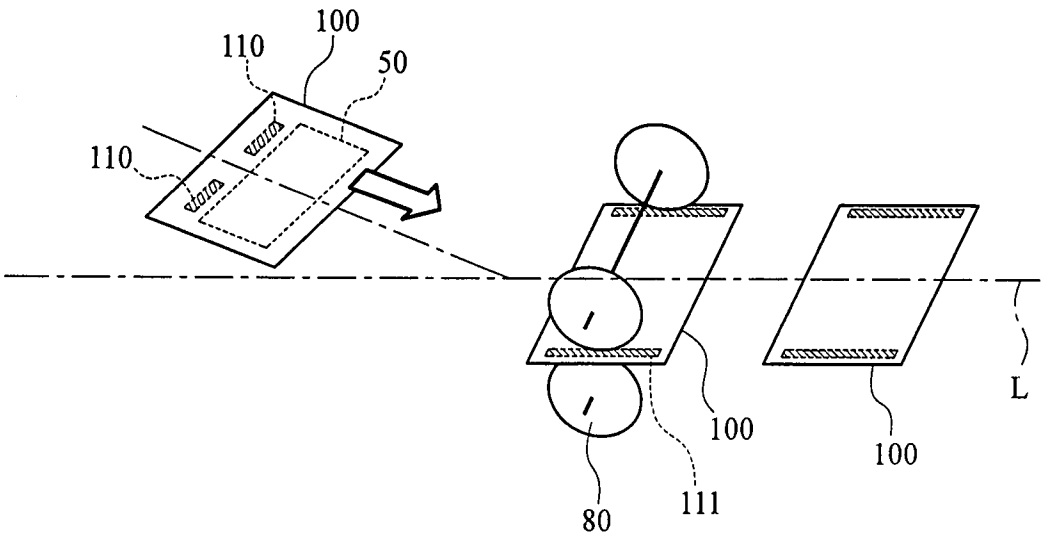
FIG. 15 is a diagram showing a resealing process after content check in the disposal processing or the reuse processing.

FIG. 15 shows a process to reseal the sealed letter to be checked shown in FIG. 14 after the content of the sealed letter is checked. In the sealed letter formation by the resealing, the content 50, which partially sticks out, is pulled out of the sealed letter to be checked, then the content is checked. When the content is correct, the content sheet 50 is manually returned to the central portion of the envelope sheet 100 with both ends opened in the widthwise direction. Then the sealed letter is put into a resealing port 32 as shown in FIG. 3. Then the envelope sheet 100 is held and conveyed with the pressure rollers 80, the pressure-sensitive adhesive 111 applied to both ends in the widthwise direction is attached, thus an envelope is completed.

Note that in the above-described embodiment, paper sheets are used as the content sheet 50 and the envelope sheet 100. However, for example, a sheet roll may be used. In this case, upon each use, the roll sheet is cut in a necessary length and supplied.

REFERENCE SIGNS LIST

1 . . . sealed letter forming apparatus
2 . . . printer
3 . . . enclosing and sealing unit
50 . . . content sheet
90 . . . controller
100 . . . envelope sheet
100*a* . . . sheet used as envelope sheet cheaper than envelope sheet (plain sheet)
120 . . . fold register line
P . . . sheet feed unit (sheet feed tray)

CITATION LIST

Patent Literature

{Patent Literature 1} Japanese Published Unexamined Patent Application No. Hei 7-25198
{Patent Literature 2} Japanese Published Unexamined Patent Application No. 2001-96987

The invention clamied is:

1. A sealed letter forming apparatus comprising:
a sheet feed unit containing an envelope sheet to be an envelope and a content sheet to be a content;
a printer printing on the envelope and content sheets supplied from the sheet feed unit, respectively;
an enclosing and sealing unit folding the envelope and content sheets printed by the printer, and enclosing and sealing the content sheet in the envelope sheet; and
a controller controlling the enclosing and sealing unit,
wherein a combination of the envelope sheet and the content sheet is defined as an article, and sealed letter forming processing is performed with respect to each article,
when an error related to the envelope sheet or the content sheet in a first n-th article (n is a positive integer) occurs, the controller controls the enclosing and sealing unit to stop the sealed letter forming processing and to discharge the first n-th article including a first n-th envelope sheet and a first n-th content sheet, and thereafter, when the error is canceled, the controller controls the enclosing and sealing unit to perform the sealed letter forming processing without sealing a second n-th article following the first n-th article as a sealed letter to be checked manually.

2. The sealed letter forming apparatus according to claim 1, wherein the controller controls the enclosing and sealing unit to perform enclosing a part of the content sheet of the second n-th article to stick out from the envelope sheet thereof.

3. The sealed letter forming apparatus according to claim 1, wherein the controller has a checking mode selection unit for selecting a checking method after canceling the error, and wherein in the checking mode selection unit, when a first disposal mode is selected manually, the controller controls the enclosing and sealing unit to perform the sealed letter forming processing without sealing the second n-th article, and to restart the sealed letter forming processing from a third n-th article following the second n-th article after checking the sealed letter in the second n-th article manually.

4. The sealed letter forming apparatus according to claim 3, wherein, at execution of the sealed letter forming processing without sealing the second n-th article, the controller controls the printer to print disposal information on the envelope sheet of the second n-th article to inform that the second n-th article is disposed.

5. The sealed letter forming apparatus according to claim 1, wherein the controller has a checking mode selection unit for selecting a checking method after canceling the error, and wherein in the checking mode selection unit, when a reuse mode is selected manually, the controller controls the enclosing and sealing unit to perform the sealed letter forming processing without sealing the second n-th article as the sealed letter to be checked, and to restart the sealed letter forming processing from an n+1-th article.

6. The sealed letter forming apparatus according to claim 1, wherein the sheet feed unit contains a sheet cheaper than the envelope sheet, wherein the controller has a checking mode selection unit for selecting a checking method after canceling the error, and wherein, in the checking mode selection unit, when a second disposal mode is selected manually, the controller controls the sheet feed unit to feed the sheet cheaper than the envelope sheet as the envelope sheet of the second n-th article at execution of the sealed letter forming processing without sealing the second n-th article, and further, after the sealed letter forming processing without sealing the second n-th article to be checked, the controller controls the enclosing and sealing unit to restart the sealed letter forming processing from a third n-th article following the second n-th article.

7. The sealed letter forming apparatus according to claim 6, wherein the controller controls the printer to print a fold register line on the sheet cheaper than the envelope sheet.

8. The sealed letter forming apparatus according to claim 1, wherein the controller has a checking mode selection unit for selecting a checking method after canceling the error, and the checking mode selection unit includes a disposal mode and a reuse mode; and when the error occurs, in the disposal mode, the first n-th article is discharged from the enclosing and sealing unit, and the second n-th article is secondly assigned as an n-th article; and in the reuse mode, the first n-th article is discharged from the enclosing and sealing unit to be checked and thereafter, the first n-th article is manually returned in the enclosing and sealing unit.

* * * * *